US006723248B2

(12) United States Patent
Ohkawa

(10) Patent No.: US 6,723,248 B2
(45) Date of Patent: Apr. 20, 2004

(54) HIGH THROUGHPUT PLASMA MASS FILTER

(75) Inventor: Tihiro Ohkawa, La Jolla, CA (US)

(73) Assignee: Archimedes Technology Group, Inc., San Diego, CA (US)

( * ) Notice: Subject to any disclaimer, the term of this patent is extended or adjusted under 35 U.S.C. 154(b) by 55 days.

(21) Appl. No.: 10/222,475

(22) Filed: Aug. 16, 2002

(65) Prior Publication Data

US 2004/0031740 A1 Feb. 19, 2004

(51) Int. Cl.[7] ..... B03C 1/02

(52) U.S. Cl. ..... 210/695; 210/748; 210/222; 210/243; 209/12.1; 209/227; 96/2; 96/3; 95/28

(58) Field of Search ..... 210/222, 223, 210/243, 695, 512.1, 748, 787; 209/12.1, 227, 722, 725; 96/1, 2, 3; 95/28

(56) References Cited

U.S. PATENT DOCUMENTS 3,722,677 A 3/1973 Lehnert
5,868,909 A 2/1999 Eastlund
5,939,029 A 8/1999 Ohkawa
6,096,220 A 8/2000 Ohkawa
6,214,223 B1 4/2001 Ohkawa
6,235,202 B1 5/2001 Ohkawa
6,248,240 B1 6/2001 Ohkawa
6,251,281 B1 6/2001 Ohkawa
6,251,282 B1 6/2001 Putvinski et al.
6,322,706 B1 11/2001 Ohkawa

*Primary Examiner*—David A. Reifsnyder
(74) *Attorney, Agent, or Firm*—Nydegger & Associates

(57) ABSTRACT

A high throughput plasma mass filter includes a substantially cylindrical shaped plasma chamber with structures for generating a magnetic field (B) that is crossed with an electric field (E) in the chamber (E×B). An injector introduces into the chamber a multi-species plasma having ions of different mass to charge ratios. To obtain high throughput (Γ), the initial density of this multi-species plasma is considerably greater than a collisional density wherein there is a probability of "one" that an ion collision will occur within a single rotation of the ion under the influence of E×B. The length of the chamber is chosen to insure heavy ions can make their way to the wall before transiting the device.

19 Claims, 1 Drawing Sheet

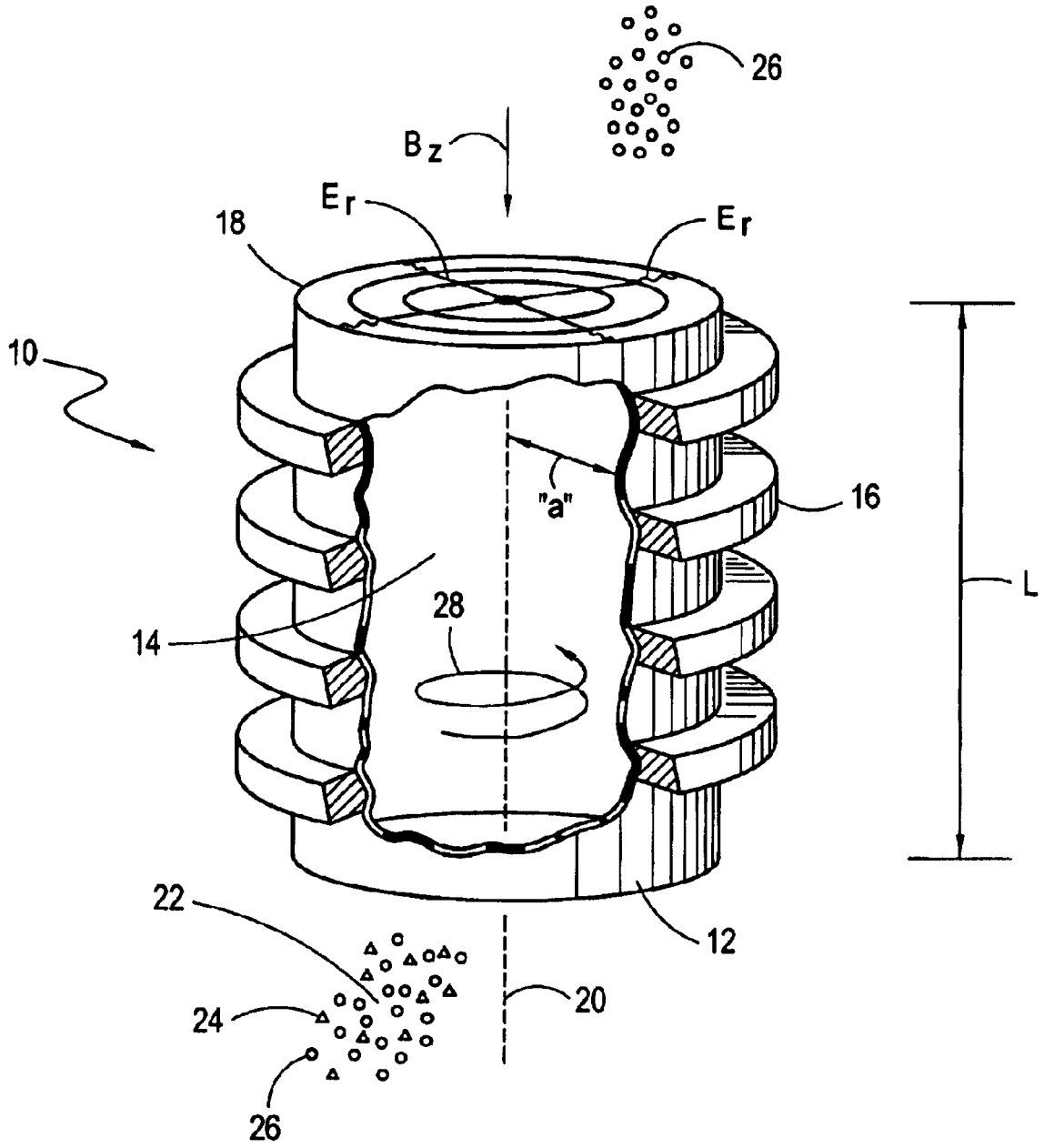
Figure

HIGH THROUGHPUT PLASMA MASS FILTER

FIELD OF THE INVENTION

The present invention pertains generally to devices and methods for separating ions of relatively high mass to charge ratios ($M_1$) from ions of relatively low mass to charge ratios ($M_2$), when both are present in a multi-species plasma. In particular, the present invention pertains to devices incorporating plasma mass filter technology that relies on crossing an axially oriented magnetic field with an outwardly-directed and radially-oriented electric field. More particularly, but not exclusively, the present invention pertains to plasma mass filters that incorporate plasma mass filter technology with inputs of multi-species plasma densities above a predetermined collisional density for the plasma.

BACKGROUND OF THE INVENTION

In a conventional plasma centrifuge, all of the ions in the plasma, both light and heavy ions, are in what is commonly called a potential well. In this condition, they are localized in a region where the potential energy of each ion is appreciably lower than it would be outside the region. Thus, such a potential well effectively forms a trap for the ions of a rotating plasma that tends to confine the ions. Furthermore, conventional plasma centrifuges operate in a collisional regime wherein the density of ions in the plasma causes them to collide with each other. For the operation of a plasma centrifuge, these collisions are necessary because they transfer energy between the ions in a manner that causes the heavier ions to accumulate near the periphery of the rotating plasma. At the same time, lighter ions are confined nearer the center of the rotating plasma. Consequently, through this action, the heavier ions are generally separated from the light ions.

Unlike a plasma centrifuge, the present invention pertains to plasma mass filters of the type disclosed in U.S. Pat. No. 6,096,220, which issued to Ohkawa for an invention entitled "Plasma Mass Filter," and which is assigned to the same assignee as the present invention (hereinafter sometimes referred to as the Ohkawa patent). The Ohkawa patent is incorporated herein by reference. In clear contrast with plasma centrifuges, plasma mass filters incorporate crossed electric and magnetic fields (E×B) that effectively create a potential hill in the chamber of the filter for the heavier ions ($M_1$). Such a potential hill, however, prevents the passage of a charged particle (e.g. a light ion, $M_2$) across the potential hill (barrier) unless it has energy greater than that corresponding to the potential hill (barrier). For a plasma mass filter, the establishment of the potential hill is accomplished by directing the radial electric field, $E_r$, in a direction that is opposite to that of a conventional centrifuge.

As disclosed in the Ohkawa patent, the determination as to whether an ion is a heavy ion ($M_1$) or a light ion ($M_2$), is dependent on its relationship to a so-called cut-off mass ($M_c$). As defined in the Ohkawa patent, the cut-off mass for ion differentiation is expressed as:

$$M_c = zea^2(B_z)^2/8V_{ctr}$$

wherein "ze" is the ion charge, "a" is the distance of the plasma chamber wall from its longitudinal axis, wherein the magnetic field has a magnitude "$B_2$" in a direction along the longitudinal axis, and there is a positive potential on the longitudinal axis that has a value "$V_{ctr}$", and further wherein the chamber wall has a substantially zero potential. Under these conditions, heavy ions ($M_1$) are defined as having mass to charge ratios greater than the cut-off mass ($M_c$), with light ions ($M_2$) having mass to charge ratios less than the cut-off mass ($M_c$), (i.e. $M_1 > M_c > M_2$).

Heretofore, the standard operating procedure for a plasma mass filter has been to establish a plasma throughput, Γ, such that the plasma density remains below a defined collisional density, $n_c$. More specifically, for the purposes of the present invention, the "collisional density," $n_c$, is defined as being a plasma density wherein there is a probability of "one" that an ion collision will occur within a single orbital rotation of an ion around the chamber axis under the influence of crossed electric and magnetic fields (E×B). In other words, a collisional density, $n_c$, is established when it is just as likely that an ion will collide with another ion, as it is that the ion will not collide with another ion during a single orbital rotation. In order to improve the plasma throughput, Γ, of a plasma filter, however, it may be desirable to operate the filter with plasma densities above the collisional density, $n_c$. Fortunately, as recognized by the present invention, the effective operation of a plasma mass filter is possible under controlled conditions with plasma densities substantially above the collisional density, if the device is long enough to allow radial collection of collision impeded heavy ions.

In light of the above, it is an object of the present invention to provide a high throughput plasma mass filter which is effective in its operation with plasma densities above a collisional density, $n_c$. Another object of the present invention is to provide a high throughput plasma mass filter which effectively separates ions of relatively high mass to charge ratios, $M_1$, from ions of relatively low mass to charge ratios, $M_2$, when $M_1$ is generally greater than $2M_2$. Still another object of the present invention is to establish an operating regime for a high throughput plasma mass filter which increases its throughput capability. Yet another object of the present invention is to provide a high throughput plasma mass filter which is relatively easy to manufacture, is simple to use, and is comparatively cost effective.

SUMMARY OF THE PREFERRED EMBODIMENTS

For the purposes of the present invention, the term "collisional density" ($n_c$) is defined as being a plasma density wherein there is a probability of "one" that an ion will experience a collision with another ion during a single orbital rotation of the ion around an axis. Specifically, such a rotation is considered to be around the axis of a plasma mass filter under the influence of crossed electric and magnetic fields (E×B). Stated differently, a collisional density ($n_c$) is established whenever it is just as likely that an ion will collide with another ion during a single orbital rotation about the filter's axis, as it is that the ion will not collide with another ion during the rotation. The main premise of the present invention is that a plasma mass filter can be operated to separate heavy ions from light ions, even when plasma densities are substantially greater than the collisional density ($n_c$).

As intended for the present invention, after the heavy and light ions have been separated from each other, the filter's throughput (Γ) will be composed almost entirely of light ions ($M_2$) from the plasma. Accordingly, for a single emitted device, this throughput can be mathematically expressed as:

$$\Gamma = \pi a^2 n_2 v_z. \quad \text{(eqn. 1)}$$

In this expression, $n_2$ is the density of the light ions per unit volume, and $v_z$ is the velocity of the plasma (for both the heavy and light ions) along the longitudinal axis of the plasma mass filter. In contrast to a collisionless filter where the heavy ions are lost very rapidly to the heavy collectors surrounding the injection zone, the heavy ions in the high throughput filter are impeded in their radial motion by collisions with other ions. As a consequence, the equivalent radial velocity of the heavy ions is reduced. Thus, for a given length device, the number of heavy ions reaching the light collector can be estimated by solving a simplified continuity equation:

$$v_z \frac{\partial}{\partial z} n + \frac{1}{r}\frac{\partial}{\partial r}(rnv_r) = 0 \qquad \text{(eqn. 2)}$$

Assuming there is no radial dependence of the density or the heavy ion velocity and no axial variation in the heavy ion axial velocity, the above eqn. 2 gives:

$$\mathrm{Log}_\theta(n(z)/n_0) = -(Lv_r/rv_z) = F \qquad \text{(eqn. 3)}$$

where F is the logarithmic separation factor, L is the length of the device, $v_z$ is the axial velocity of the heavy ions, $v_r$ is the radial velocity of the heavy ions, and r is the distance to the wall from the starting point. It is clear from equation (3) that for good separation, the length has to be long enough to allow the heavy ions to escape radially before they transit the device (F is the ratio of the axial loss time to the radial loss time for the heavy ions). The heavy ion radial velocity can be obtained from the equations of motion including collisions. More particularly, a range for the radial velocity "$v_r$" can be determined by considering boundary conditions where: 1) the rotational velocity of the heavy ions, $M_1$, is zero ($v_\theta=0$); and 2) where this rotational velocity equals that of the light ions, $M_2$ ($v_\theta=v_\theta'$). With these boundary conditions, the radial velocity, $v_r$, can be mathematically expressed as:

$$v_r = r[\Omega_c\Omega^*/4\nu]\epsilon. \qquad \text{(eqn. 4)}$$

In the above expression: "ν" is the ion-ion collision frequency; "$\Omega_c$" is the cyclotron frequency for an ion of cut-off mass, $M_c$, and "$\Omega^*$" is the cyclotron frequency of the light ions $M_2$. For case 1 above, $\epsilon=1$ and for case 2, $\epsilon=[M_1-M_2]/4M_c$ so $\epsilon$ can be evaluated more precisely in actual cases. An important observation from these relationships is the fact that "$v_r$" is a function of $\Omega_c$, $\Omega^*$, and ν. A high throughput plasma mass filter in accordance with the present invention includes a substantially cylindrical shaped plasma chamber. The chamber has a length "L" and defines a longitudinal axis. Further, it has a wall that is located at a radial distance "a" from the axis. Magnetic coils are mounted on the wall of the chamber to generate a magnetic field (B) in the chamber having a magnitude B. Also, a series of conducting rings are mounted on the chamber and are centered on the longitudinal axis to generate a radial electric field E. A spiral electrode could also be used for this purpose.

Inside the chamber of the plasma mass filter, the magnetic field (B) is oriented substantially parallel to the axis, and the electric field (E) is oriented substantially perpendicular to the magnetic field to cross the electric field with the magnetic field (E×B). Also, it is an important aspect of the present invention that the electric field has a positive potential ($V_{ctr}$) on the longitudinal axis and a substantially zero potential on the wall.

In operation, a multi-species plasma is introduced into the chamber with an initial plasma density that is substantially greater than the collisional density. As envisioned by the present invention, this multi-species plasma will include both ions having a relatively high mass to charge ratio ($M_1$) and ions having a relatively low mass to charge ratio ($M_2$). Theoretically, the crossed electric and magnetic fields (E×B) are configured to remove the heavy ions ($M_1$) in a length, L, and provide a throughput (Γ) for the light ions ($M_2$) as they transit through the chamber.

In order to mathematically determine how an ion in the multi-species plasma will be affected by the high throughput plasma mass filter, it is necessary to determine whether the charged particle is a heavy ion ($M_1$) or a light ion ($M_2$). For the present invention, this distinction is made relative to a particle having a predetermined cut-off mass ($M_c$). Specifically, a relationship is established for $M_1>M_c>M_2$, by the expression below, wherein "e" is the charge of a singly ionized ion:

$$M_c = zea^2(B_z)^2/8V_{ctr}.$$

The operating parameters of the plasma mass filter for separating heavy ions ($M_1$) from light ions ($M_2$) can be established by first determining a value for E where generally:

$$[M_1-M_2]4M_c \leqq \epsilon \leqq 1.$$

When considering "ε", and referring back to (eqn. 4), it is to be appreciated that for purposes of the present invention, it is preferable for the heavy ions ($M_1$) to have more than about twice the mass of the light ions ($M_2$), (i.e. $M_1>2M_2$). It is clear that a filter device designed for high throughput requires a longer total length than a standard filter and a proportionally longer heavy ion collector.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

The FIGURE is a perspective view of a plasma mass filter in accordance with the present invention.

DESCRIPTION OF THE PREFERRED EMBODIMENT

Referring to the FIGURE, a plasma mass filter in accordance with the present invention is shown and is generally designated 10. There it will be seen that the filter 10 includes a substantially cylindrical shaped wall 12 that surrounds a chamber 14. Also, it can be seen that a plurality of magnetic coils 16 are positioned on the outside of the wall 12 of filter 10 to establish a magnetic field ($B_z$) inside the chamber 14. Further, a plurality of electrode rings 18 are positioned on the filter 10 to establish a radial electric field ($E_r$) inside the chamber 14. As intended for the filter 10 of the present invention, the magnetic field ($B_z$) is oriented along the axis 20 of the chamber 14 substantially as indicated, and-the electric field ($E_r$) is radially oriented on the axis 20 substantially as indicated. Importantly, the electric field ($E_r$) is generated by creating a positive potential ($V_{ctr}$) at the axis 20, and having a substantially zero potential at the wall 12. As described, the magnetic field and the electric field establish crossed electric and magnetic fields (E×B) in the chamber 14.

In the operation of the filter 10, a multi-species plasma 22 is introduced into the chamber 14 by any means known in the pertinent art, such as a plasma injector. As indicated in the FIGURE, when the plasma 22 is being introduced into the chamber 14, it will include both heavy ions 24 ($M_1$) and light ions 26 ($M_2$). In accordance with well known physical phenomena, while the plasma 22 is inside the chamber 14, the influence of the crossed electric and magnetic fields (E×B) will cause each of the ions in the plasma 22 (both heavy ions 24 ($M_1$) and light ions 26 ($M_2$)) to follow respective trajectories 28. As intended for the filter 10 of the present invention, the density of the plasma 22 inside the chamber 14 may be substantially greater than the collisional density ($n_c$), previously defined.

As disclosed above, a relationship can be established between the crossed electric and magnetic fields inside the chamber 14 that will establish a cut-off mass ($M_c$). Importantly, the cut-off mass ($M_c$) is established between known values for the mass to charge ratios of the heavy ions ($M_1$) and the light ions ($M_2$), (i.e. $M_1>M_c>M_2$). In this case:

$$M_c=zea^2(B_z)^2/8V_{ctr}.$$

The desired logarithmic separation factor (F) for the plasma 22 as it transits the chamber 14 is given by the expression $$F=Lf/v_z$$

wherein L is chosen such that $L>(v_z/v_r)$ a, and:

$$v_r=[\Omega_c\Omega^* /4\nu\nu]\epsilon r.$$

The actual throughput (Γ) for single ended operation of the filter 10 is given by the expression:

$$\Gamma=\pi a^2 n_2 v_z$$

By way of example, consider a filter 10 having dimensions such that $L\pi a^2=2\ m^3$. With these dimensions, a magnetic field strength of B=0.15 T, and an ion temperature $T_i$=20 eV, also consider atomic numbers $A_c$=70 and A'=20, which respectively pertain to the cut-off mass ($M_c$) and the reduced mass of the light ions ($M_2$). Then, with these operational parameters, for a 99.7% separation "F" can be established (F=2.5) and the throughput will be Γ=33ϵ mol/sec. Next, consider A=120 (for the heavy ions $M_1$) and A'=20 (for the light ions $M_2$). This gives ϵ=0.36. The overall result in this case is then an acceptable throughput of Γ=12 mol/sec.

While the particular high throughput plasma mass filter as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A high throughput plasma mass filter which comprises:

a substantially cylindrical shaped plasma chamber defining a longitudinal axis and having a wall at a radial distance "a" from said axis;

a means for generating crossed electric and magnetic fields (E×B) in said chamber, with said magnetic field being oriented substantially parallel to said axis;

a means for introducing into said chamber a multi-species plasma having an initial plasma density (n), said multi-species plasma including ions having a relatively high mass to charge ratio ($M_1$) and ions having a relatively low mass to charge ratio ($M_2$), and wherein the initial density of said multi-species plasma is greater than a collisional density ($n>n_c$); and a means for varying said crossed electric and magnetic fields (E×B) in said chamber to establish a predetermined logarithm separating factor, F, for the initial plasma density (n).

2. A high throughput plasma mass filter as recited in claim 1 wherein said electric field is radially oriented with a positive potential ($V_{ctr}$) on said longitudinal axis and a substantially zero potential on said wall.

3. A high throughput plasma mass filter as recited in claim 2 wherein "e" is the charge of a particle, the magnetic field has a magnitude $B_z$, and a relationship is established for $M_1>M_c>M_2$, where $$M_c=zea^2(B_z)^2/8V_{ctr}.$$

4. A high throughput plasma mass filter as recited in claim 1 wherein said chamber has a length "L", and the logarithmic separation factor is predetermined with $L/v_z>a/v_r$ where $v_z$ is axial velocity of the ions $M_1$, and $v_r$ is the radial velocity.

5. A high throughput plasma mass filter as recited in claim 1 wherein said means for generating said magnetic field is a magnetic coil mounted on said wall.

6. A high throughput plasma mass filter as recited in claim 1 wherein said means for generating said electric field is an electrode mounted on said longitudinal axis at one end of said chamber.

7. A high throughput plasma mass filter as recited in claim 1 wherein the heavy ions ($M_1$) have more than twice the mass of the light ions ($M_2$), ($M_1>2M_2$).

8. A high throughput plasma mass filter which comprises:

a substantially cylindrical shaped plasma chamber defining an axis and having a wall at a radial distance "a" from said axis;

a means for generating crossed electric and magnetic fields (E×B) in said chamber, with said magnetic field being oriented substantially parallel to said axis;

an injector for introducing into said chamber a multi-species plasma including ions having a mass to charge ratio ($M_1$) wherein said multi-species plasma has an initial density greater than a defined collisional density ($n>n_c$); and a means for generating said crossed electric and magnetic fields (E×B) to establish a logarithmic separation function (F) for the ions ($M_1$), wherein said logarithmic separation function (F) involves a ratio between an input flux of the ions ($M_1$) into the chamber and an output flux of the ions ($M_1$), and further wherein said logarithmic separation function (F) is indicative of a radial movement of the ions ($M_1$) away from said axis and into contact with the wall for removal from said multi-species plasma.

9. A high throughput plasma mass filter as recited in claim 8 wherein said collisional density is defined as a density wherein there is a probability of "one" that an ion collision will occur within a single rotation of an ion around said axis under the influence of said crossed electric and magnetic fields E×B.

10. A high throughput plasma mass filter as recited in claim 9 wherein said multi-species plasma includes ions having a mass to charge ratio ($M_2$), with $M_1$ being greater than $M_2$, and further wherein said crossed electric and magnetic fields (E×B) substantially confine the ions ($M_2$) in said chamber during passage therethrough.

11. A high throughput plasma mass filter as recited in claim 10 wherein the ions ($M_1$) have more than twice the mass of the ions ($M_2$), ($M_1>2M_2$).

12. A high throughput plasma mass filter as recited in claim 10 wherein said electric field is radially oriented with a positive potential ($V_{ctr}$) on said longitudinal axis and a substantially zero potential on said wall.

13. A high throughput plasma mass filter as recited in claim 10 wherein "e" is the charge of a particle, the magnetic field has a magnitude $B_z$, and a relationship is established for $M_1>M_c>M_2$, where $$M_c=zea^2(B_z)^2/8V_{ctr}.$$

14. A method for increasing the throughput of a plasma mass filter which comprises the steps of:

providing a substantially cylindrical shaped plasma chamber defining a longitudinal axis and having a wall at a radial distance "a" from said axis;

introducing into said chamber a multi-species plasma having an initial plasma density, said multi-species plasma including ions having a relatively high mass to charge ratio ($M_1$) and ions having a relatively low mass to charge ratio ($M_2$), and wherein the initial density of said multi-species plasma is greater than a collisional density, said collisional density being defined as a density wherein there is a probability of "one" that an ion collision will occur within a single rotation of an ion around said axis under the influence of said crossed electric and magnetic fields E×B; and generating crossed electric and magnetic fields (E×B) in said chamber, with said magnetic field being oriented substantially parallel to said axis, to comply with a predetermined condition wherein the chamber has a length "L" and wherein $L/v_z>a/v_r$ with $v_z$ being an axial velocity and $v_r$ being a radial velocity for the ions $M_1$.

15. A method as recited in claim 14 further comprising the step of radially orienting said electric field with a positive potential ($V_{ctr}$) on said longitudinal axis and a substantially zero potential on said wall.

16. A method as recited in claim 15 wherein "e" is the charge of a particle, the magnetic field has a magnitude $B_z$, and a relationship is established for $M_1>M_c>M_2$, where $$M_c=zea^2(B_z)^2/8V_{ctr}.$$

17. A method as recited in claim 14 wherein said logarithmic separation function (F) involves a ratio between an input flux of the ions ($M_1$) into the chamber and an output flux of the ions ($M_1$) with the throughput, and further wherein said logarithmic separation function (F) is indicative of a radial movement of the ions ($M_1$) away from said axis and into contact with said wall of said chamber for removal from said multi-species plasma.

18. A method as recited in claim 14 wherein said step of generating said magnetic field is accomplished using a magnetic coil mounted on said wall.

19. A method as recited In claim 14 wherein said step of generating said electric field is accomplished using an electrode mounted on said longitudinal axis at one end of said chamber.

* * * * *

UNITED STATES PATENT AND TRADEMARK OFFICE

CERTIFICATE OF CORRECTION

PATENT NO. : 6,723,248 B2
DATED : April 20, 2004
INVENTOR(S) : Tihiro Ohkawa

It is certified that error appears in the above-identified patent and that said Letters Patent is hereby corrected as shown below:

Column 1,
Line 55, delete "$B_2$" insert -- $B_z$ --

Column 3,
Line 19, delete "$Log_\theta$" insert -- $Log_e$ --

Column 4,
Line 21, delete "E" insert -- ε --
Line 57, delete "and-the" insert -- and the --

Column 5,
Line 28, delete "4νν" insert -- 4ν --
Line 37, delete "A'=20" insert -- A*=20 --

Signed and Sealed this

Eleventh Day of January, 2005

JON W. DUDAS
*Director of the United States Patent and Trademark Office*